US009107501B2

(12) United States Patent
Nagy et al.

(10) Patent No.: US 9,107,501 B2
(45) Date of Patent: Aug. 18, 2015

(54) EARTHQUAKE-ACTIVATED SHELF SECURITY SYSTEM

(76) Inventors: Giselle Francine Nagy, West Hills, CA (US); Michael B. Nagy, Agoura Hills, CA (US)

( * ) Notice: Subject to any disclaimer, the term of this patent is extended or adjusted under 35 U.S.C. 154(b) by 413 days.

(21) Appl. No.: 13/445,729

(22) Filed: Apr. 12, 2012

(65) Prior Publication Data

US 2012/0261366 A1 Oct. 18, 2012

Related U.S. Application Data

(60) Provisional application No. 61/474,715, filed on Apr. 12, 2011, provisional application No. 61/483,577, filed on May 6, 2011, provisional application No. 61/491,145, filed on May 27, 2011, provisional application No. 61/498,698, filed on Jun. 20, 2011, provisional application No. 61/540,431, filed on Sep. 28, 2011, provisional application No. 61/560,668, filed on Nov. 16, 2011.

(51) Int. Cl.
*A47B 97/00* (2006.01)
*A47B 96/00* (2006.01)

(52) U.S. Cl.
CPC ..... *A47B 97/00* (2013.01); *A47B 96/00* (2013.01)

(58) Field of Classification Search
CPC .... B65G 2207/40; A47B 97/00; A47B 96/00; A47B 96/02
USPC ..... 211/1, 134, 180, 183; 182/112; 248/499; 108/27, 55.1; 312/216
See application file for complete search history.

(56) References Cited

U.S. PATENT DOCUMENTS

| | | | | | |
|---|---|---|---|---|---|
| 1,075,652 | A | * | 10/1913 | Kleber, Jr. | 312/304 |
| 4,867,318 | A | * | 9/1989 | Robson | 211/40 |
| 4,981,225 | A | * | 1/1991 | Cole | 211/183 |
| 5,038,689 | A | * | 8/1991 | Duffy | 108/108 |
| 5,152,562 | A | | 10/1992 | Stevenson et al. | |
| 5,170,829 | A | * | 12/1992 | Duncan et al. | 160/84.02 |
| 5,567,029 | A | * | 10/1996 | Haenisch et al. | 312/405.1 |
| 5,573,125 | A | * | 11/1996 | Denny | 211/183 |
| 5,588,724 | A | * | 12/1996 | Emery | 312/236 |
| 5,601,198 | A | | 2/1997 | Reed | |

(Continued)

FOREIGN PATENT DOCUMENTS

| | | | | |
|---|---|---|---|---|
| JP | 04347268 A | * | 12/1992 | E04G 21/32 |
| JP | 09-078925 A | | 3/1997 | |

(Continued)

*Primary Examiner* — Stanton L Krycinski
(74) *Attorney, Agent, or Firm* — Patwrite Law; Mark David Torche

(57) ABSTRACT

An earthquake-activated shelf security system has two guide rails attached to both sides of a shelf or pallet rack. At least one retainer is moveably constrained to move along the guide rails by a rotating loop located on each end of the retainer. The guide rail has a retainer rest portion and allows the retainer to rest in a prepared configuration without moving down the rail unless acted upon by a shaking event such as an earthquake. A movable backstop is located along a back portion of the retainer rest portion. The position of the rest stop can be adjusted to adjust the sensitivity of the system to earthquakes. The guide rails have retainer stops located at selected positions to keep the retainer from moving past. In one embodiment two retainers are provided and in another embodiment, a mesh is provided to contain items that would otherwise fall through.

7 Claims, 20 Drawing Sheets

(56) References Cited

U.S. PATENT DOCUMENTS

| | | | | |
|---|---|---|---|---|
| 5,791,501 | A * | 8/1998 | Baldwin, Jr. | 211/183 |
| 5,860,535 | A * | 1/1999 | Brown | 211/42 |
| 5,984,121 | A * | 11/1999 | Cole | 211/183 |
| 6,422,406 | B1 * | 7/2002 | Kessel et al. | 211/181.1 |
| 6,585,122 | B2 * | 7/2003 | Calleja | 211/183 |
| 6,609,621 | B2 * | 8/2003 | Denny et al. | 211/189 |
| 6,619,490 | B2 * | 9/2003 | Calleja | 211/183 |
| 6,641,236 | B2 * | 11/2003 | Grudzien | 312/216 |
| 6,672,546 | B2 * | 1/2004 | Calleja | 248/58 |
| 6,698,604 | B2 * | 3/2004 | Denny et al. | 211/189 |
| 6,722,512 | B2 * | 4/2004 | Scully | 211/183 |
| 6,837,388 | B2 * | 1/2005 | Calleja | 211/183 |
| 6,938,785 | B2 * | 9/2005 | Denny et al. | 211/183 |
| 7,014,053 | B2 * | 3/2006 | Calleja | 211/183 |
| 7,037,055 | B1 | 5/2006 | Rogers et al. | |
| 7,150,361 | B2 * | 12/2006 | Calleja | 211/49.1 |
| 7,156,475 | B2 * | 1/2007 | Gloger, Jr. | 312/216 |
| 7,191,907 | B2 * | 3/2007 | Conway | 211/180 |
| 8,359,986 | B2 * | 1/2013 | Sekiguchi et al. | 109/53 |
| 2002/0144965 | A1 * | 10/2002 | Calleja | 211/183 |
| 2002/0144966 | A1 * | 10/2002 | Calleja | 211/183 |
| 2002/0148799 | A1 * | 10/2002 | Denny et al. | 211/186 |
| 2002/0158034 | A1 * | 10/2002 | Denny et al. | 211/189 |
| 2003/0127406 | A1 * | 7/2003 | Calleja | 211/183 |
| 2004/0020886 | A1 * | 2/2004 | Scully | 211/183 |
| 2004/0080105 | A1 * | 4/2004 | Stevenson | 271/278 |
| 2004/0182809 | A1 * | 9/2004 | Calleja | 211/180 |
| 2004/0211740 | A1 * | 10/2004 | Denny et al. | 211/183 |
| 2005/0000928 | A1 * | 1/2005 | Calleja | 211/183 |
| 2005/0056605 | A1 * | 3/2005 | Calleja | 211/183 |
| 2005/0199569 | A1 * | 9/2005 | Calleja | 211/189 |
| 2005/0258119 | A1 * | 11/2005 | Calleja | 211/183 |
| 2005/0263470 | A1 * | 12/2005 | Horneland | 211/183 |
| 2007/0187349 | A1 * | 8/2007 | Calleja | 211/189 |
| 2008/0296243 | A1 | 12/2008 | Greenbaum | |
| 2011/0049074 | A1 * | 3/2011 | Woolard | 211/191 |
| 2011/0068943 | A1 * | 3/2011 | Lane, Jr. | 340/668 |

FOREIGN PATENT DOCUMENTS

| | | | | | |
|---|---|---|---|---|---|
| JP | 09094125 | A | * | 4/1997 | A47B 96/00 |
| JP | 09173170 | A | * | 7/1997 | A47B 96/02 |
| JP | 11-103984 | A | | 4/1999 | |
| JP | 2002112845 | A | | 4/2002 | |
| JP | 2005-021641 | A | | 1/2005 | |
| JP | 2005052603 | A | | 3/2005 | |
| JP | 2005312565 | A | * | 11/2005 | A47B 96/02 |
| JP | 2006-297023 | A | | 11/2006 | |
| JP | 2010187850 | A | * | 9/2010 | |
| JP | 2010194157 | A | | 9/2010 | |
| JP | 2011125670 | A | * | 6/2011 | |
| JP | 2011200478 | A | * | 10/2011 | |
| JP | 2006297023 | A | | 11/2011 | |
| JP | 2012105820 | A | * | 6/2012 | |

* cited by examiner

EARTHQUAKE-ACTIVATED SHELF SECURITY SYSTEM

CROSS REFERENCE TO RELATED APPLICATIONS

This application claims priority to Provisional Application Ser. Nos. 61/474,715, filed on Apr. 12, 2011, 61/483,577, filed on May 6, 2011, 61/491,145, filed on May 27, 2011, 61/498,698, filed on Jun. 20, 2011, 61/540,431, filed on Sep. 28, 2011 and 61/560,668, filed on Nov. 16, 2011, the complete disclosures of each of which are hereby incorporated by reference.

BACKGROUND OF THE INVENTION

There are generally over a million earthquake events every year with over a thousand of them being over magnitude 5.0. The National Earthquake Information Center (NEIC) reports about 50 earthquakes per day. We have made great progress in building our structures to be able to withstand most earthquakes which has helped to lower the cost in human life during these events, however, earthquakes still cause a tremendous amount of economic damage.

Grocery and other retail stores, laboratories, lumber yards, and warehouses and almost anyone who stores things on shelves can lose a lot of money when even a minor earthquake hits. Many items can be damaged or destroyed when falling from the shelves on which they are stored on. To help with this problem, it is known to add straps, bars and other barriers across the front of the shelves; however, these fixes make the items stored on the shelves harder to access and detract from the esthetic look of the shelves. Since earthquake events are random events, having to put up with these disadvantages are difficult since most of the time, the protections are not needed. Some systems require user activation on the first warning of the quake and this is an obvious disadvantage since most earthquakes are not predictable.

There is a need for an easy to use, non-obtrusive earthquake-activated shelf security system that is reliable, cost efficient and not esthetically distractive. There is also a need for an earthquake-activated shelf security system that can be used with existing shelf systems.

SUMMARY OF THE INVENTION

An earthquake-activated shelf security system has two guide rails attached to both sides of a shelf or pallet rack. At least one retainer is moveably constrained to move along the guide rails by a rotating loop located on each end of the retainer. The guide rail has a retainer rest portion and allows the retainer to rest in a prepared configuration without moving down the rail unless acted upon by a shaking event such as an earthquake. A movable backstop is located along a back portion of the retainer rest portion. The position of the rest stop can be adjusted to adjust the sensitivity of the system to earthquakes. The guide rails have retainer stops located at selected positions to keep the retainer from moving past. In one embodiment two retainers are provided and in another embodiment, a mesh is provided to contain items that would otherwise fall through.

Other features and advantages of the instant invention will become apparent from the following description of the invention which refers to the accompanying drawings.

DETAILED DESCRIPTION OF THE INVENTION

Figure 1:
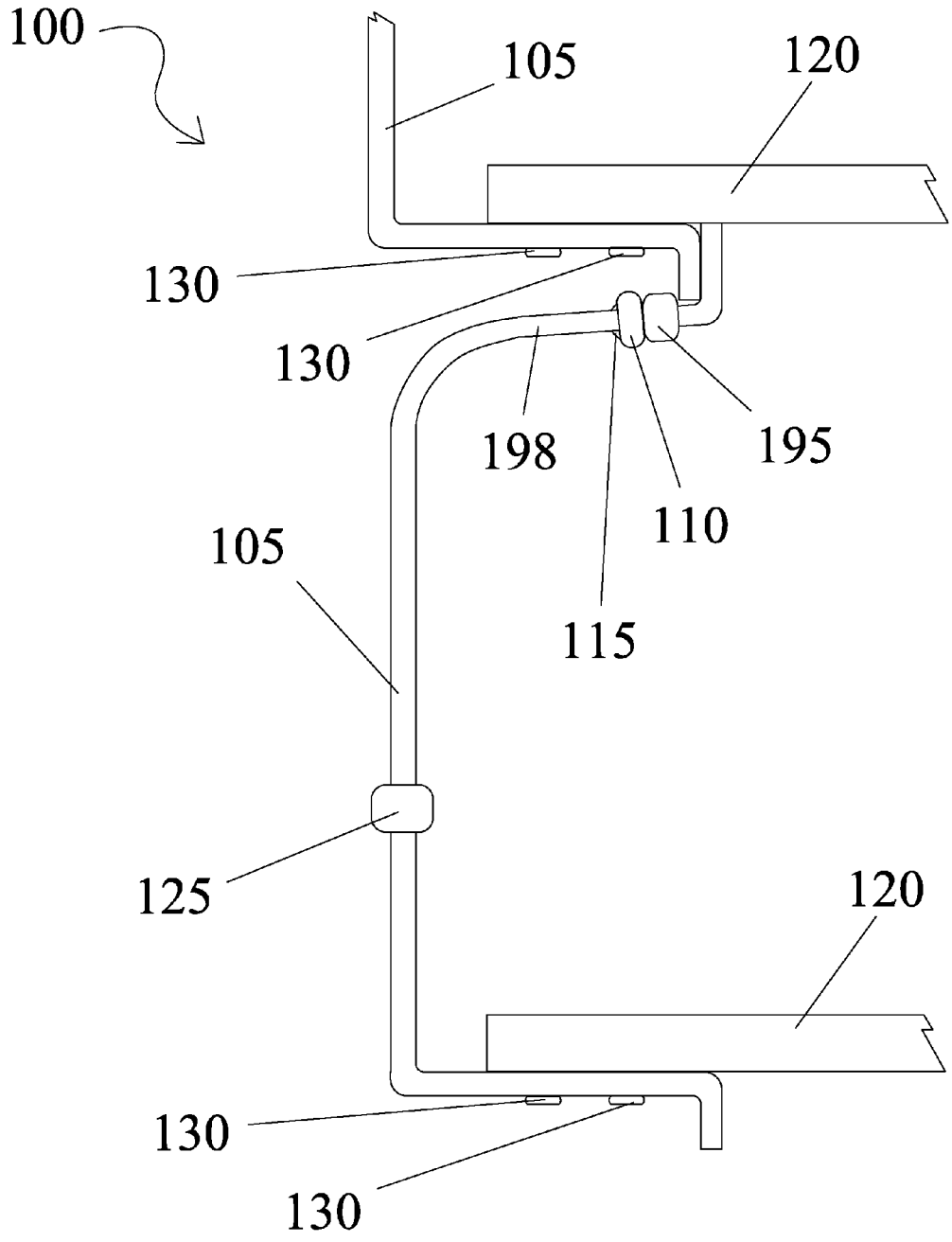
FIG. 1 is a side view of a guide rail of an earthquake-activated shelf security system according to an embodiment of the invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1, 2 and 19A and 19B an earthquake-activated shelf security system 100 is shown having a pair of guide rails 105 that are located on either side of a shelf 120. A retainer 115 has a looped end 110 that is rotably held in place on each of its ends. As looped end 110 engages with guide rail 105, it is free to rotate as well as moving in and out as shown in position A and then to position B. Of course an infinite number of positions are available and the two positions shown are not meant to limit this disclosure. In the embodiment shown, looped end 110 fits within a hollow portion of retainer 115 which allows this movement. Of course other means of allowing movement are useable as long as the desired movement is achieved. Other means include, but not limited to, bushings, bearings, pistons, etc. as is known in the art. In the embodiment shown, the shank portion of looping end 110 is long enough so that even if one side of retainer 115 were at a different height than the other, looped ends 100 would not fall out. This length may be different depending on the height of the shelf protected by the instant invention.

Now referring to FIGS. 1, 2 and 7A and 7B, a back stop 195 is provided to allow the user to adjust the sensitivity by sliding back and forth along a retainer rest portion 198. The further from the front back stop 195 is placed (position A), the more shaking required to activate it. Likewise, as back stop 195 is moved forward (position B), the less shaking is required to activate. Additionally, back stop 195 provides the user with a convenient way to reset after activation.

Again with reference to FIGS. 1 and 2, a retainer stop 125 is provided to limit the travel of retainer 115 as it moves along guide rail 105. Retainer stop 125 is user moveable by sliding up and down along guide rail 105. Retainer stop 125 is made of a compressible material like rubber or other material which frictional makes contact with guide rail 105 yet still allowing the user to move it to a selected position depending on what is being stored on shelf 120. Of course other retainer stops could be used such as using a set screw, pin or even permanently attached without departing from the instant invention.

Retainer rest portion is selected to be in the range of 1 degree to 10 degrees with a selected angle of 3 degrees from the horizontal working well in many environments. The steeper the angle, the more sensitive to shaking; however, if the angle is too great, the system may be accidentally activated. In the embodiment shown, fasteners 130 are used to secure guide rails 105 to shelf 120 as is known in the art. If desired, a top faster may be used to secure the upper portion of guide rail 105 to the lower portion of another guide rail 105. Additionally, a tab slot may be used to hold the upper portion without actually using a fastener. The tab slot is a channel that is shaped to hold the top portion of the guide rail.

Figure 2:
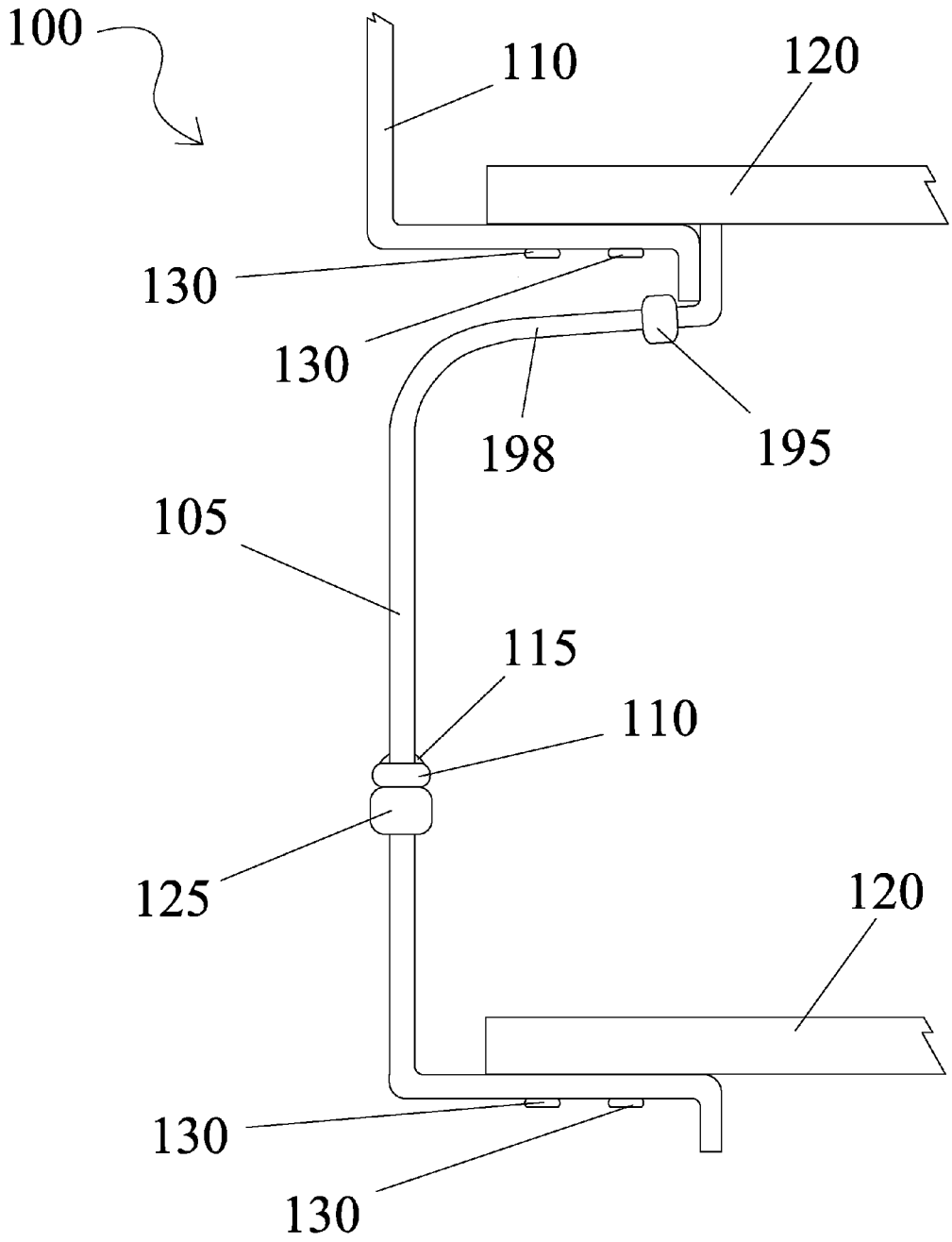
FIG. 2 is a side view of the guide rail shown in FIG. 1 in an activated configuration.

As is shown in FIG. 2, retainer 115 is shown activated after an earthquake. Retainer 115 is now in place to prevent any items (not shown) stored on shelf 120 from falling.

Figure 3:
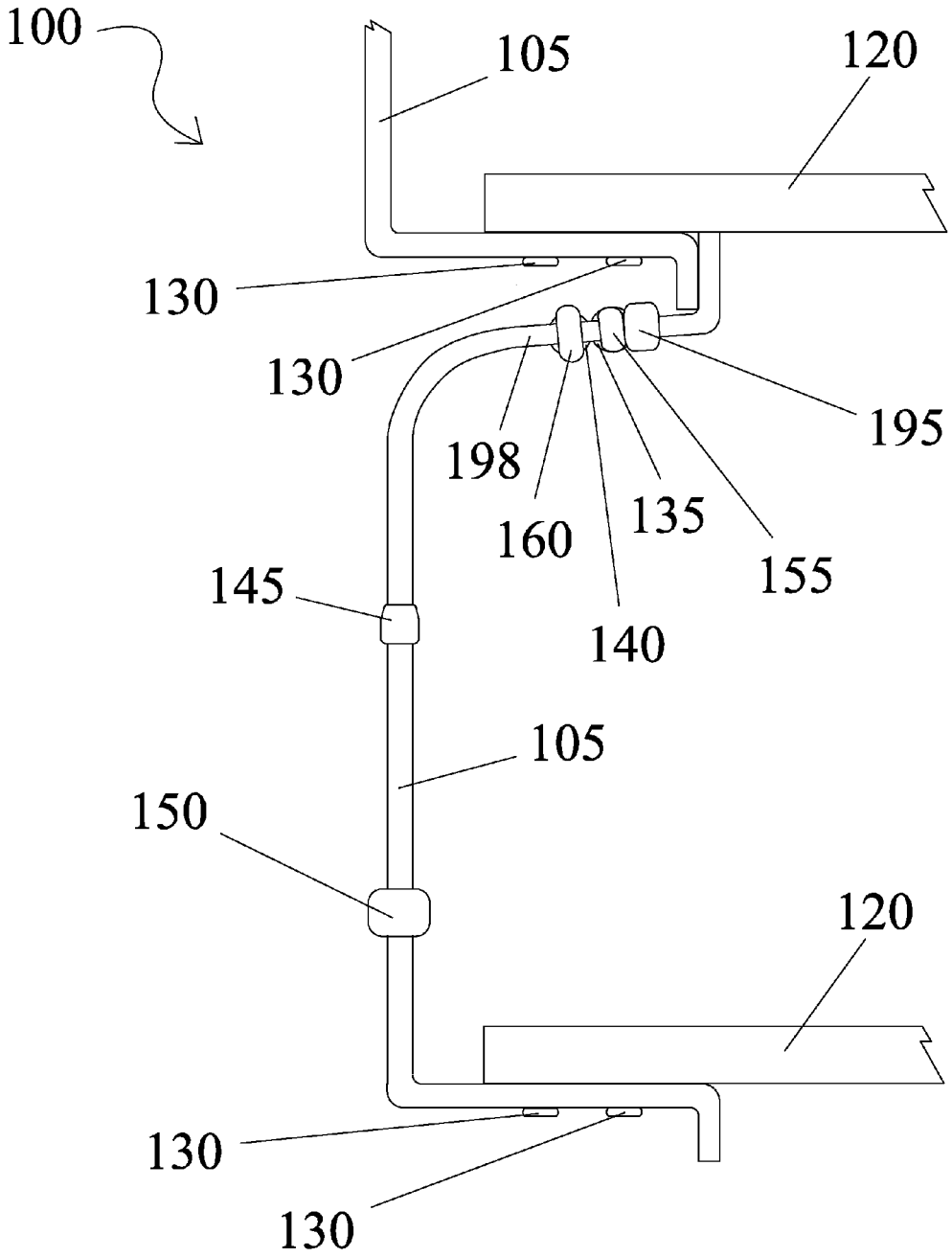
FIG. 3 is a side view of the guide rail shown in FIG. 1 with two retainers.
Figure 4:
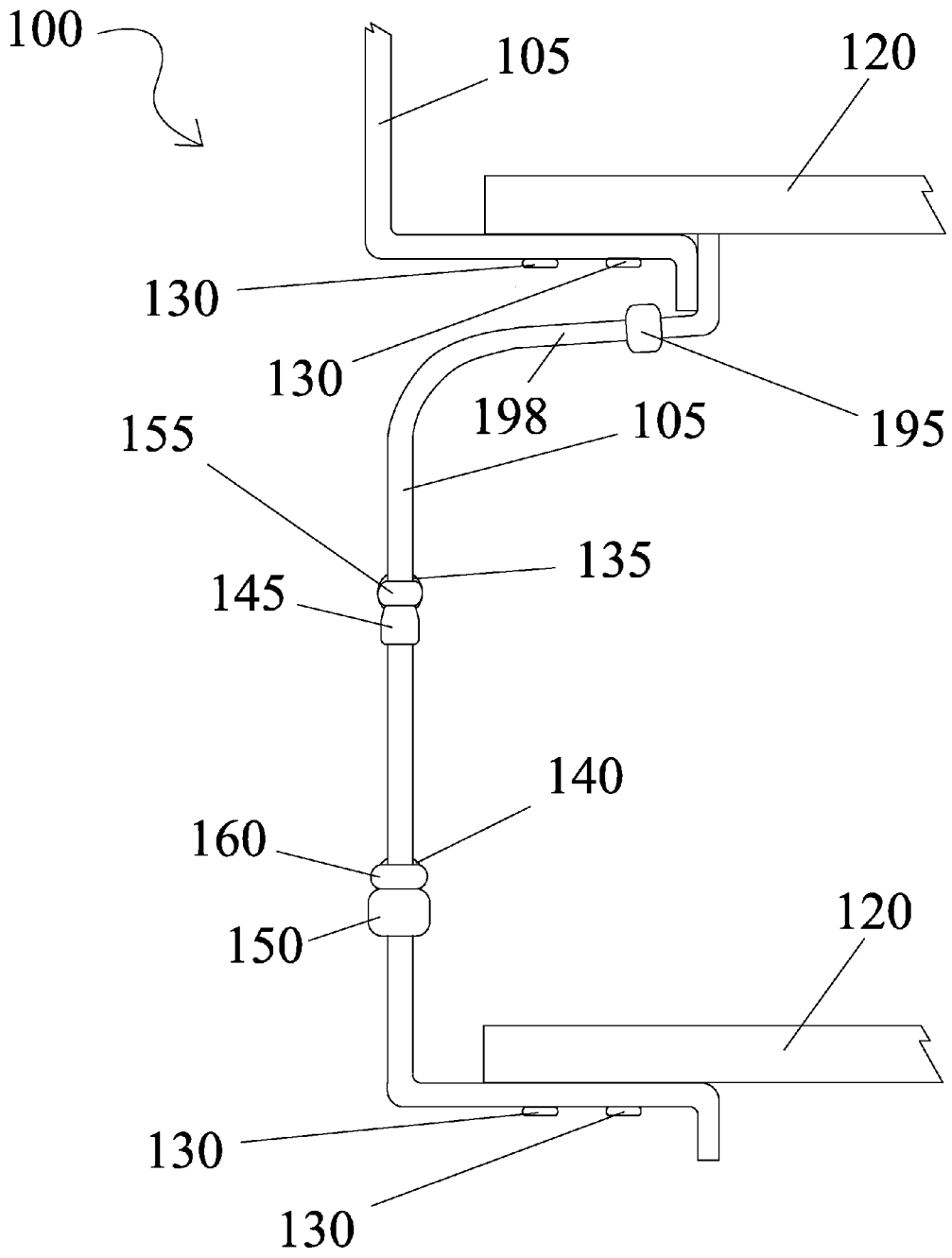
FIG. 4 is a side view of the guide rail shown in FIG. 3 in an activated configuration.

Now referring to FIGS. 3 and 4, earthquake-activated shelf security system 100 is shown having multiple retainers. An upper retainer 135 has an upper looped end 155 that rotates as discussed above. A lower retainer 140 has a lower looped end 160. Upper looped end 155 has a smaller diameter opening than lower looped end 160. Lower looped end 160 fits over and upper retainer stop 145 and continues down guide rail 105 until it is stopped by a larger lower retainer stop 150. In this embodiment, two retainers are implemented to provide additional protection to items stored on shelf 120 such as bottles which could tip over or roll under a single retainer. After activation, the user simply pushes retainers 135 and 140 back up to retainer rest 198 against back stop 195 and it is ready for the next event.

Figure 5:
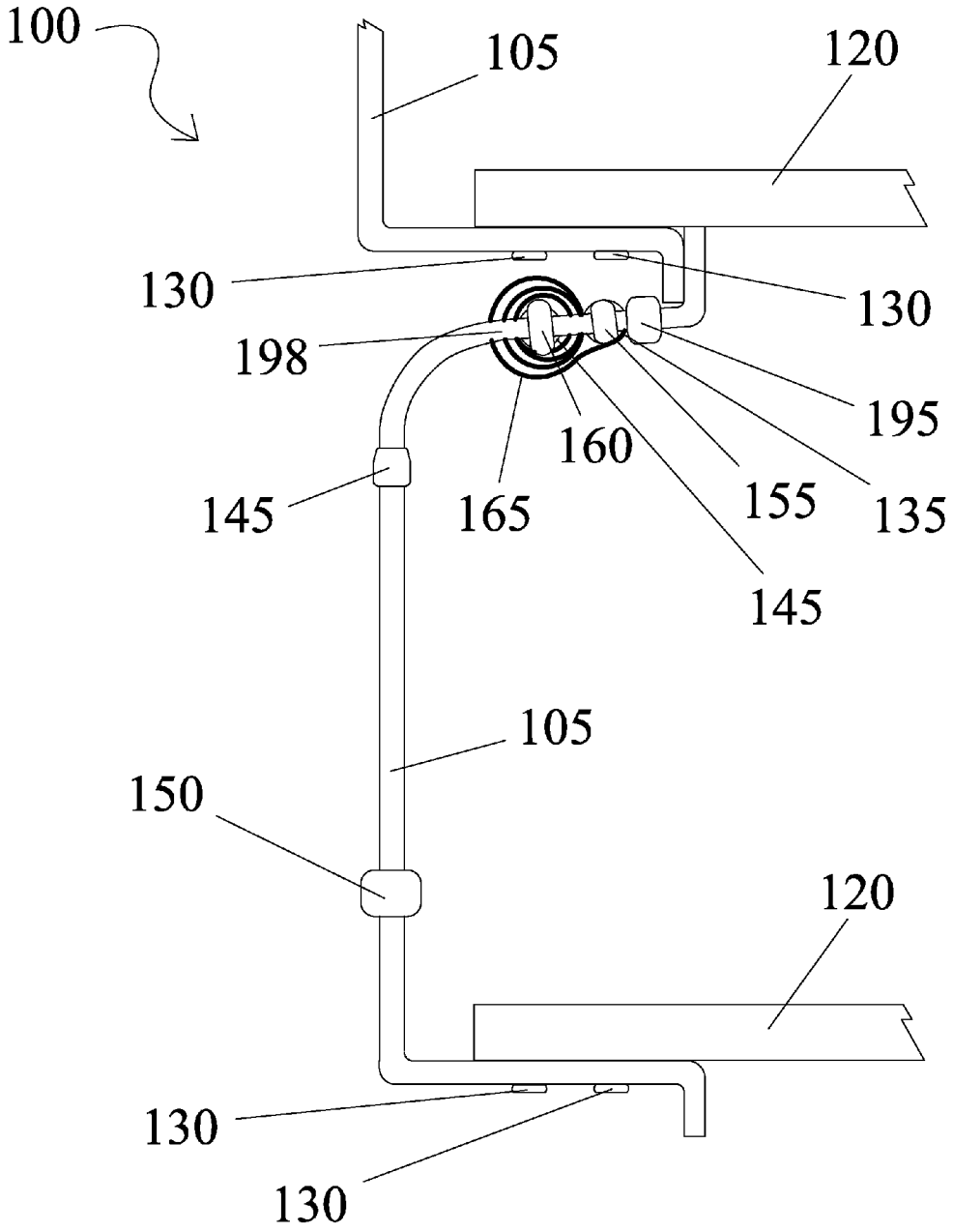
FIG. 5 is a side view of the guide rail shown in FIG. 1 with a mesh net.
Figure 6:
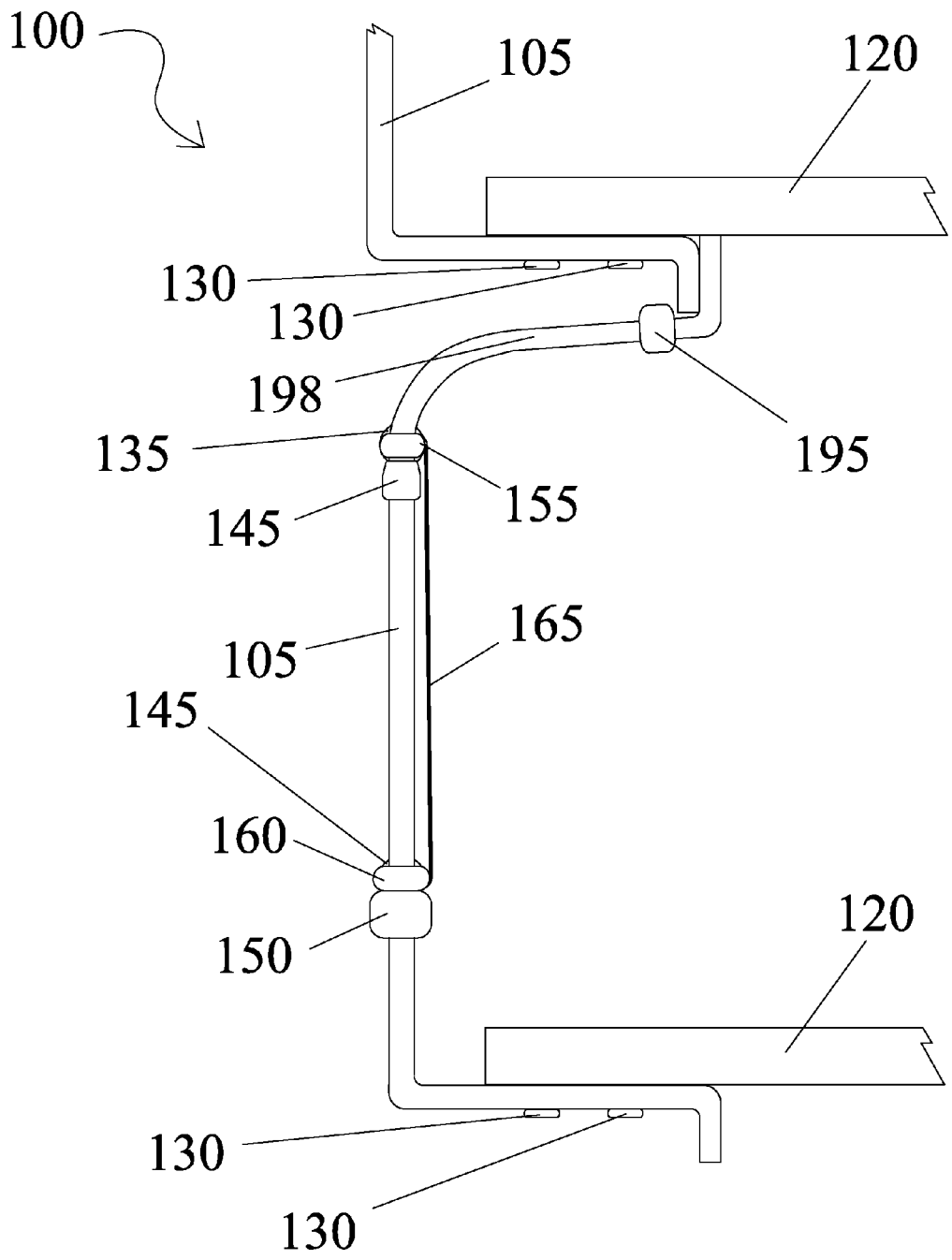
FIG. 6 is a side view of the guide rail shown in FIG. 5 in an activated configuration.
Figure 7A:
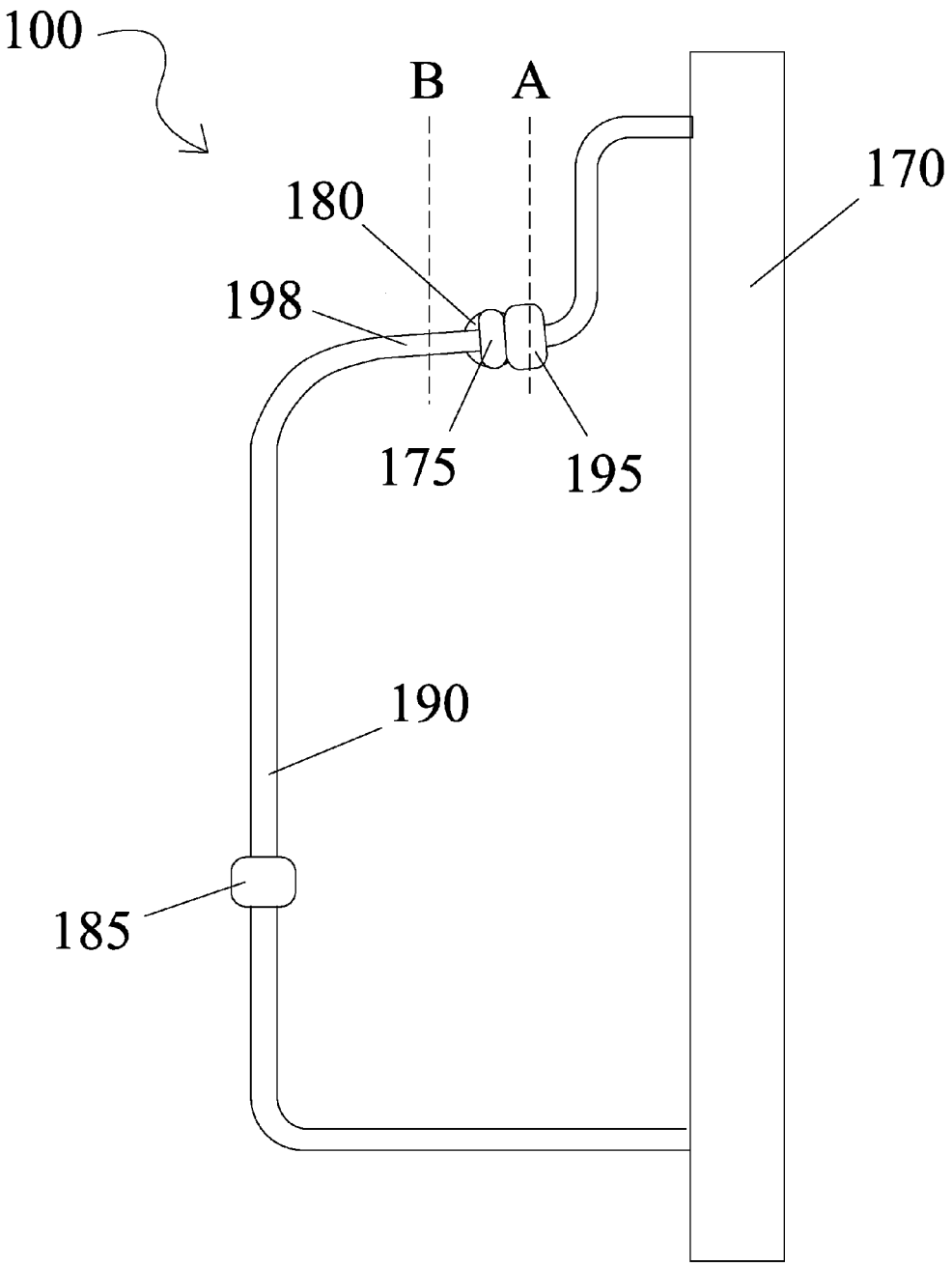
FIG. 7A is a side view of the guide rail shown in figure one in a less sensitive selected initial position.
Figure 7B:
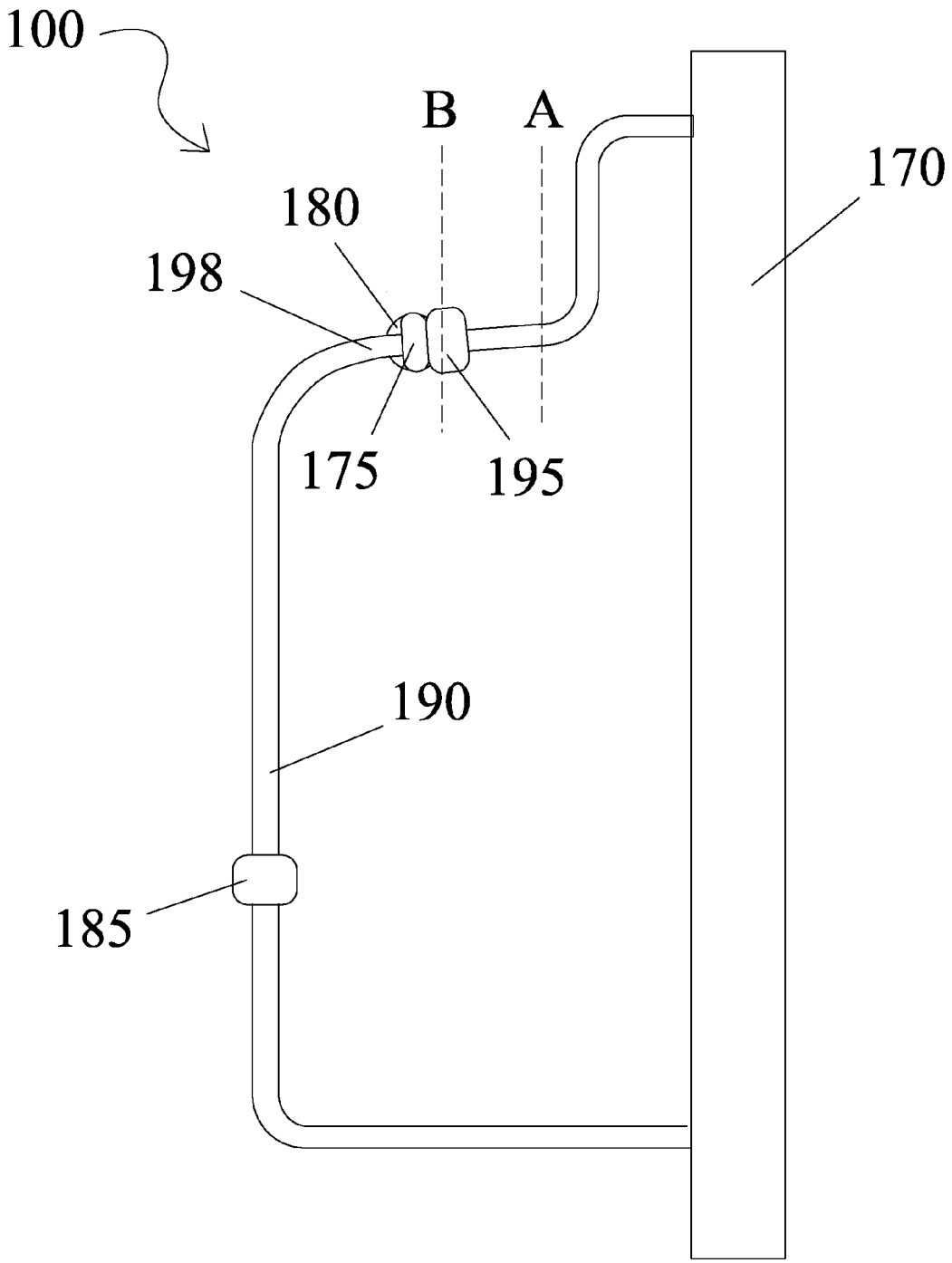
FIG. 7B is a side view of the guide rail shown in figure one in a more sensitive selected initial position.

Referring now to FIGS. 5 and 6, a mesh net 165 is connected to upper retainer 135 and a lower retainer 140. Mesh net 165 is rolled around lower retainer 140 and then placed on retainer rest portion 198. During an event, mesh net 165 unrolls as upper retainer 135 is stopped by upper retainer stop 145 and lower retainer 140 continues down to lower retainer stop 150 and mesh net 165 is then in place to protect objects that would fall through if only the retainers were used. After activation, the user rolls mesh net 165 back up and placed back in retainer rest portion 198. Mesh net 165 is made of a netting material such as nylon or other suitable material. Of course mesh netting 165 could also be a solid plastic or cloth sheet as long as it is flexible enough to roll up.

Figure 8:
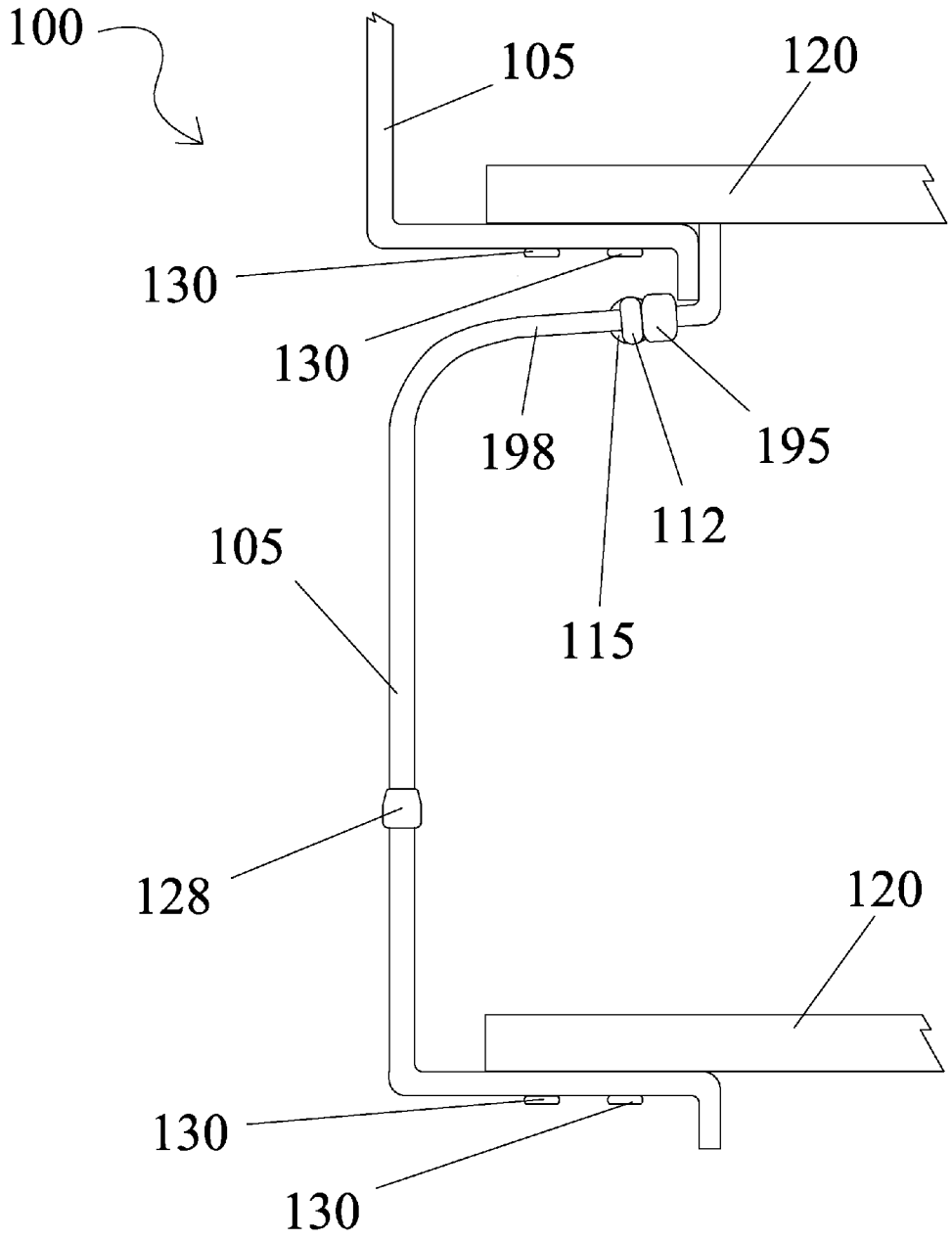
FIG. 8 is a side view of the guide rail shown in figure one having a smaller retainer stop.

Now referring to FIG. 8, earthquake-activated shelf security system 100 is shown having a small retainer stop 128 that is used to increase the esthetic appeal. Retainer 115 uses a small looped end 112 to interact with retainer stop 128 which allows a user to work with the items stored on shelf 120 while minimizing any distraction caused by the system. In other ways, this embodiment is like the ones discussed above.

Figure 9:
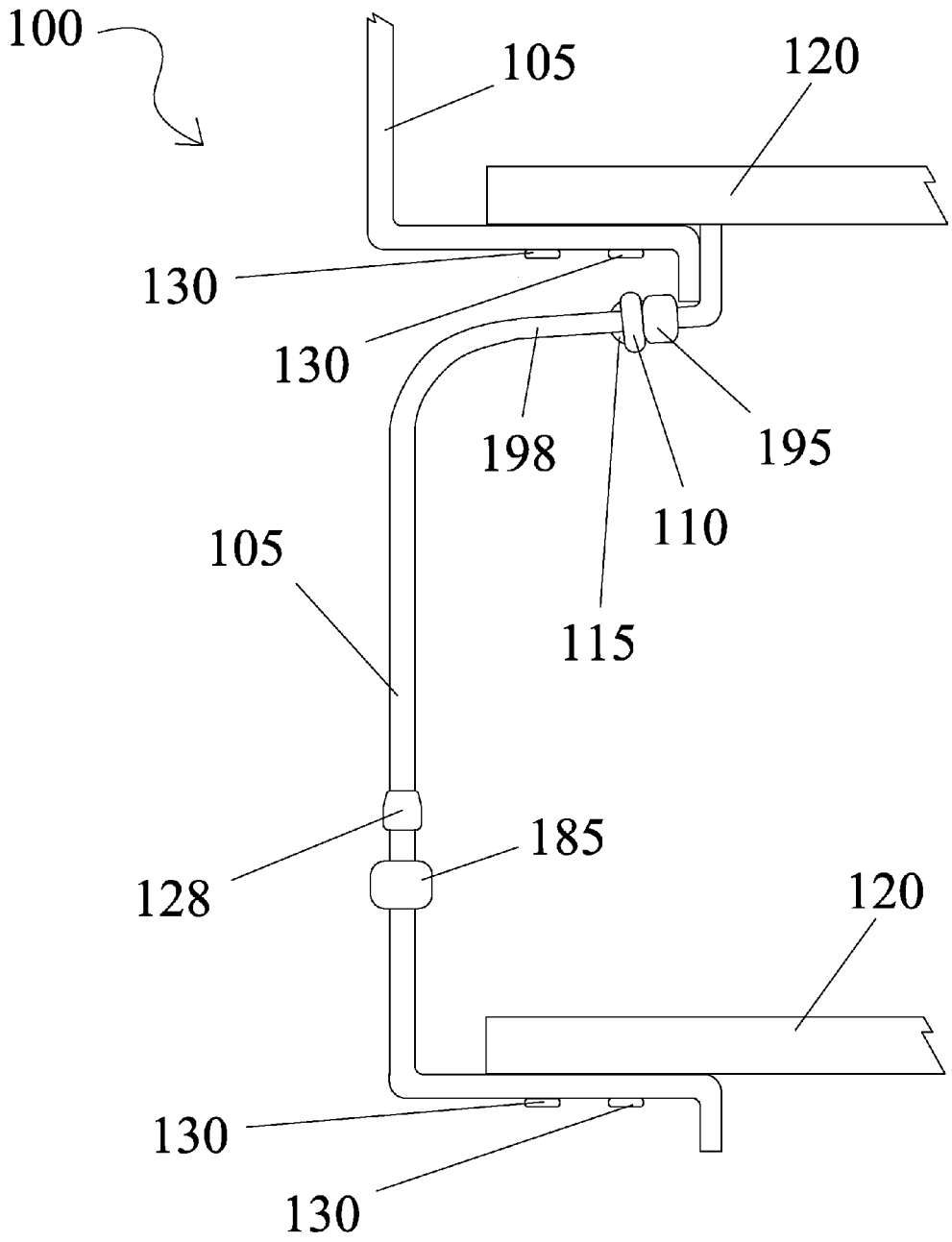
FIG. 9 is a side view of the guide rail shown in figure one having an additional retainer stop.
Figure 10:
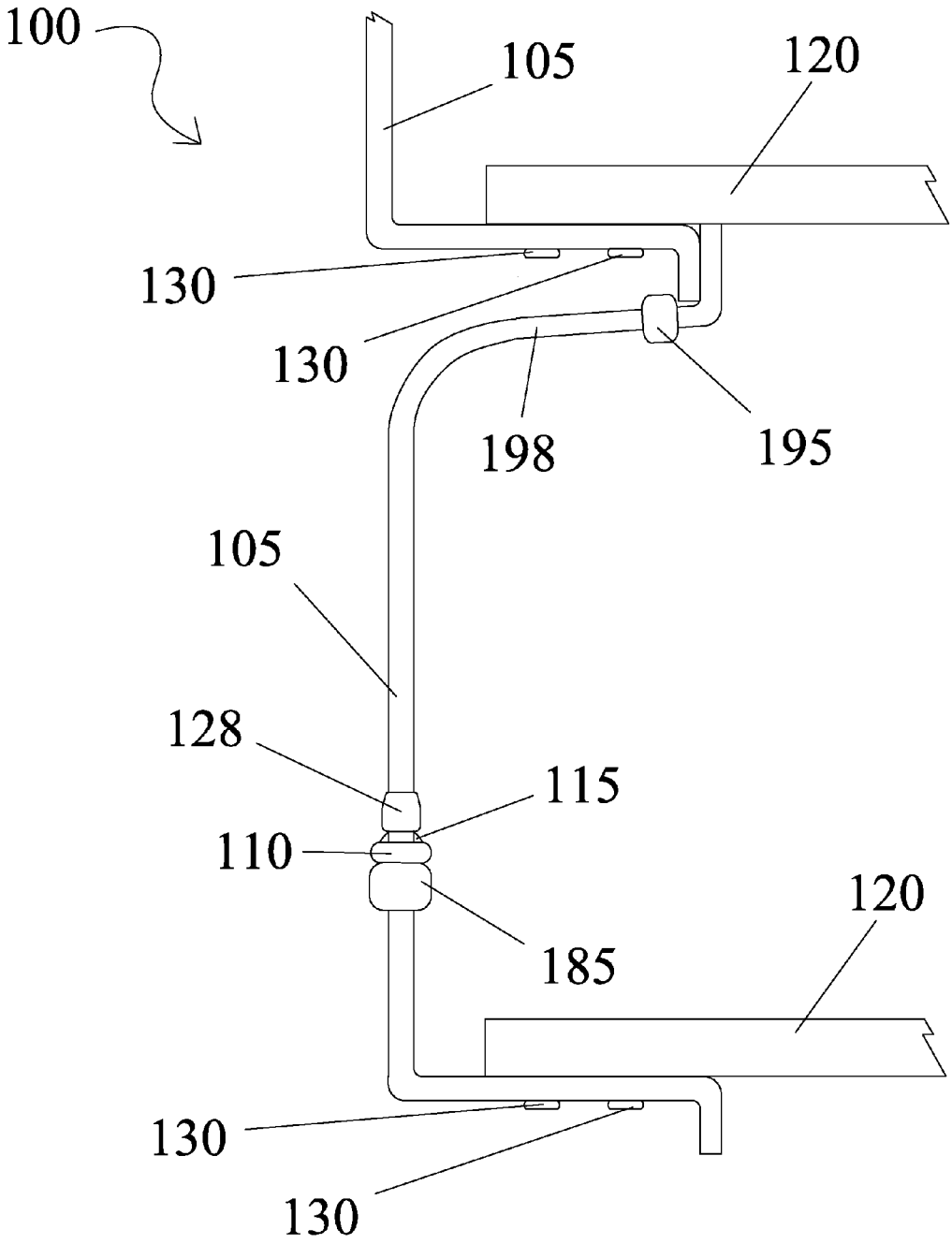
FIG. 10 is a side view of the guide rail shown in FIG. 9 in an activated configuration.

Referring now to FIGS. 9 and 10, earthquake-activated shelf security system 100 is shown having an extra retainer stop 128 disposed close to a larger retainer stop 185. Retainer stop 185 stops retainer 115 from falling any further when activated and retainer stop 128 is used to further stabilize retainer 115 when activated thus preventing retainer 115 from being pushed upward when items from shelf slide into lower retainer 140 or mesh net 165. Again, except as discussed above, this embodiment performs like the embodiments shown in FIGS. 1-6.

Figure 11:
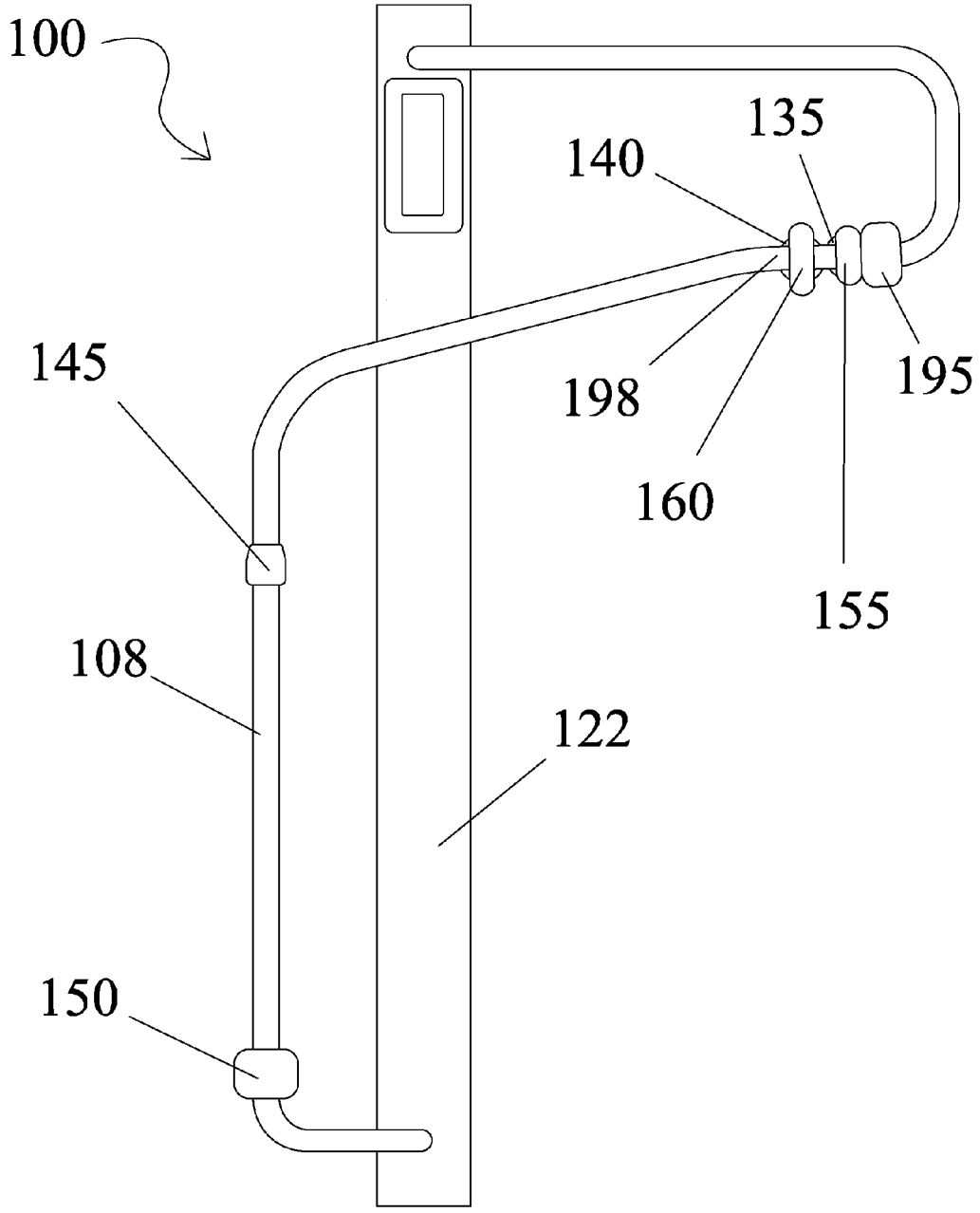
FIG. 11 is a side view of a guide rail of an earthquake-activated shelf security system according to an embodiment of the invention.
Figure 12:
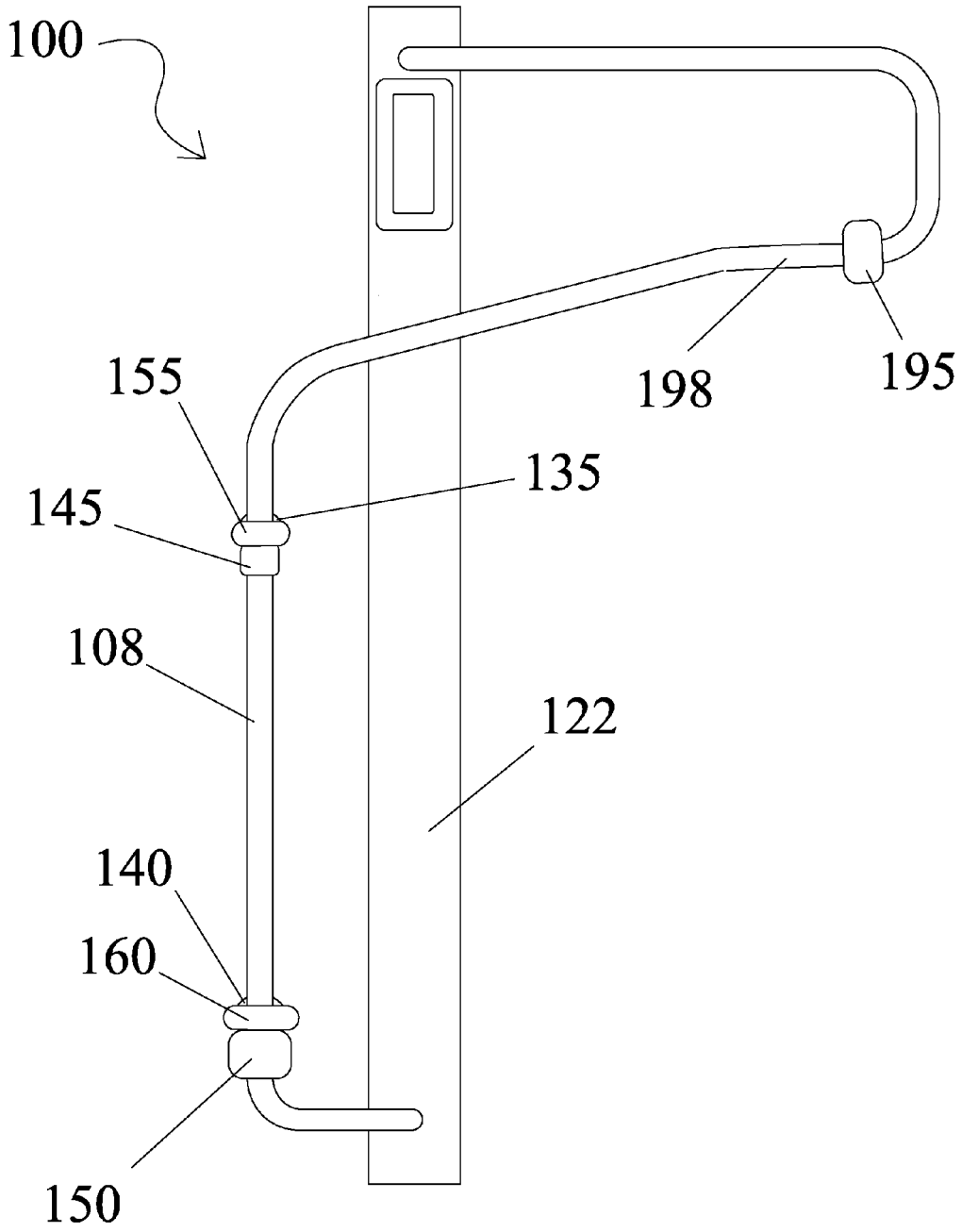
FIG. 12 is a side view of the guide rail shown in FIG. 11 in an activated configuration.

Now referring to FIGS. 11 and 12, earthquake-activated shelf security system 100 is shown mounted on an inside portion of shelf 122 to minimize the intrusiveness of the system by only having a small portion of a guide rail 108 showing and retainer rest portion 198 being placed out of the way. An intermediate portion of guide rail 108 is used to allow this configuration with retainer rest portion 198 using the ideal angle that allows retainers 135 and 140 to continue falling into place once activated by an earthquake.

Figure 13:
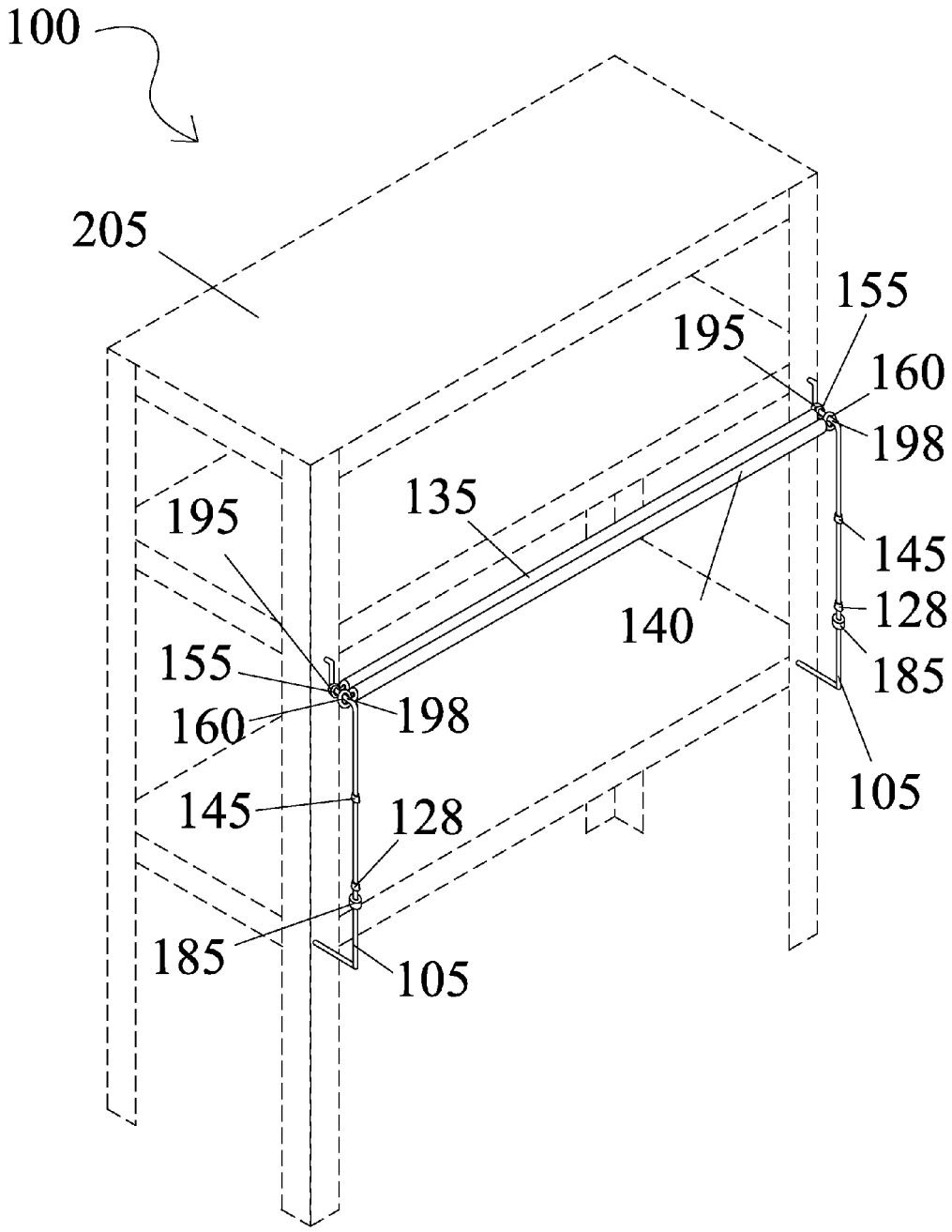
FIG. 13 is a perspective view of a shelf unit having an earthquake-activated security system installed according to an embodiment of the invention.
Figure 14:
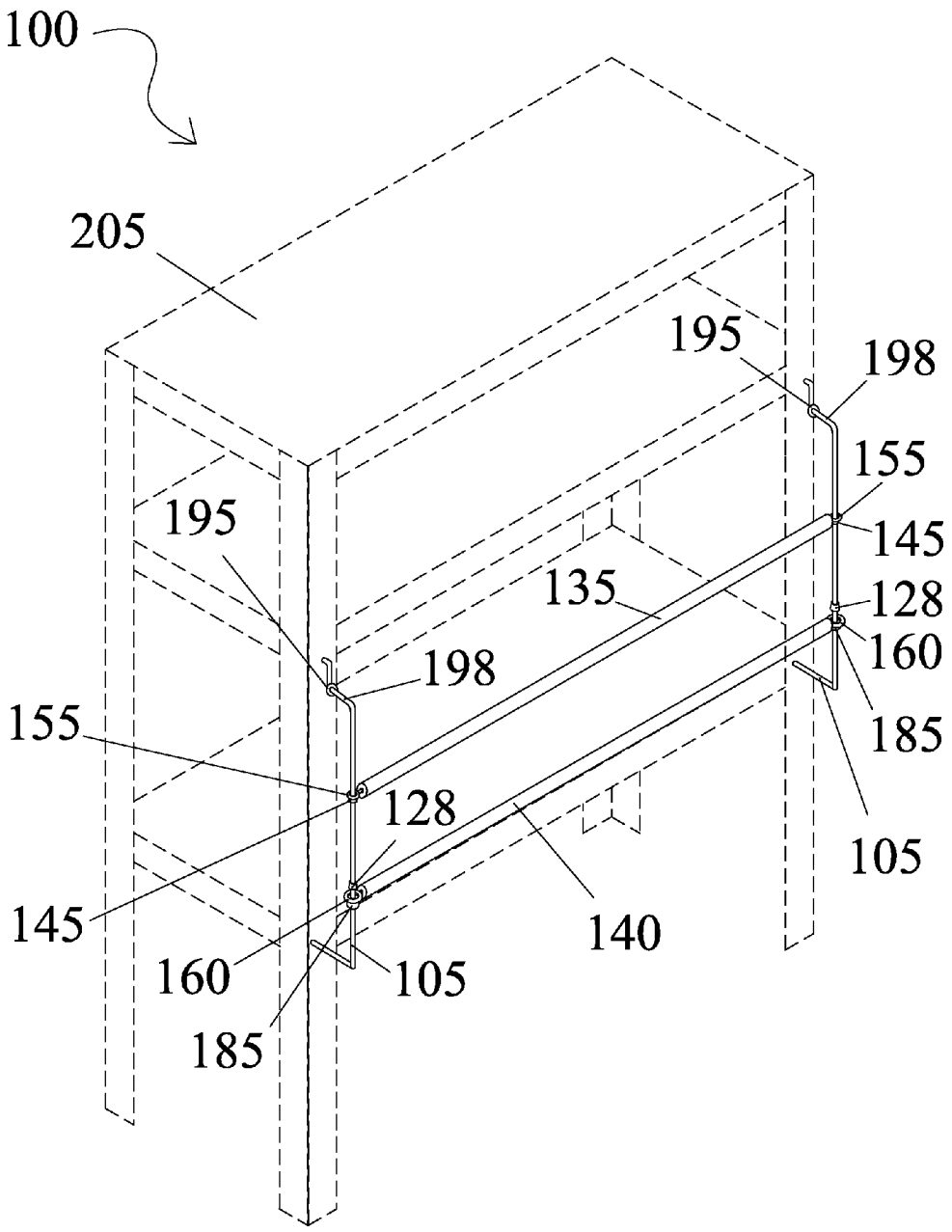
FIG. 14 is a perspective view of the shelf unit having an earthquake-activated security system shown in FIG. 13 in an activated configuration.

In FIGS. 13 and 14, earthquake-activated shelf security system 100 is shown attached to a shelf unit 205. Although for simplicity, the system is only shown attached to one shelf, it is understood that the system can be placed on each and every shelf. In FIG. 13, the system is prepped by placing retainers 135 and 140 in retainer rest portion 198. In an earthquake, shelf unit 205 may shake in any direction which will immediately cause retainers 135 and 140 respectively to fall along guide rails 105. Lower retainer 140 falls past upper retainer stop 145 and is stopped by lower retainer stop 185 while upper retainer 135 is stopped by upper retainer stop 145.

Figure 15:
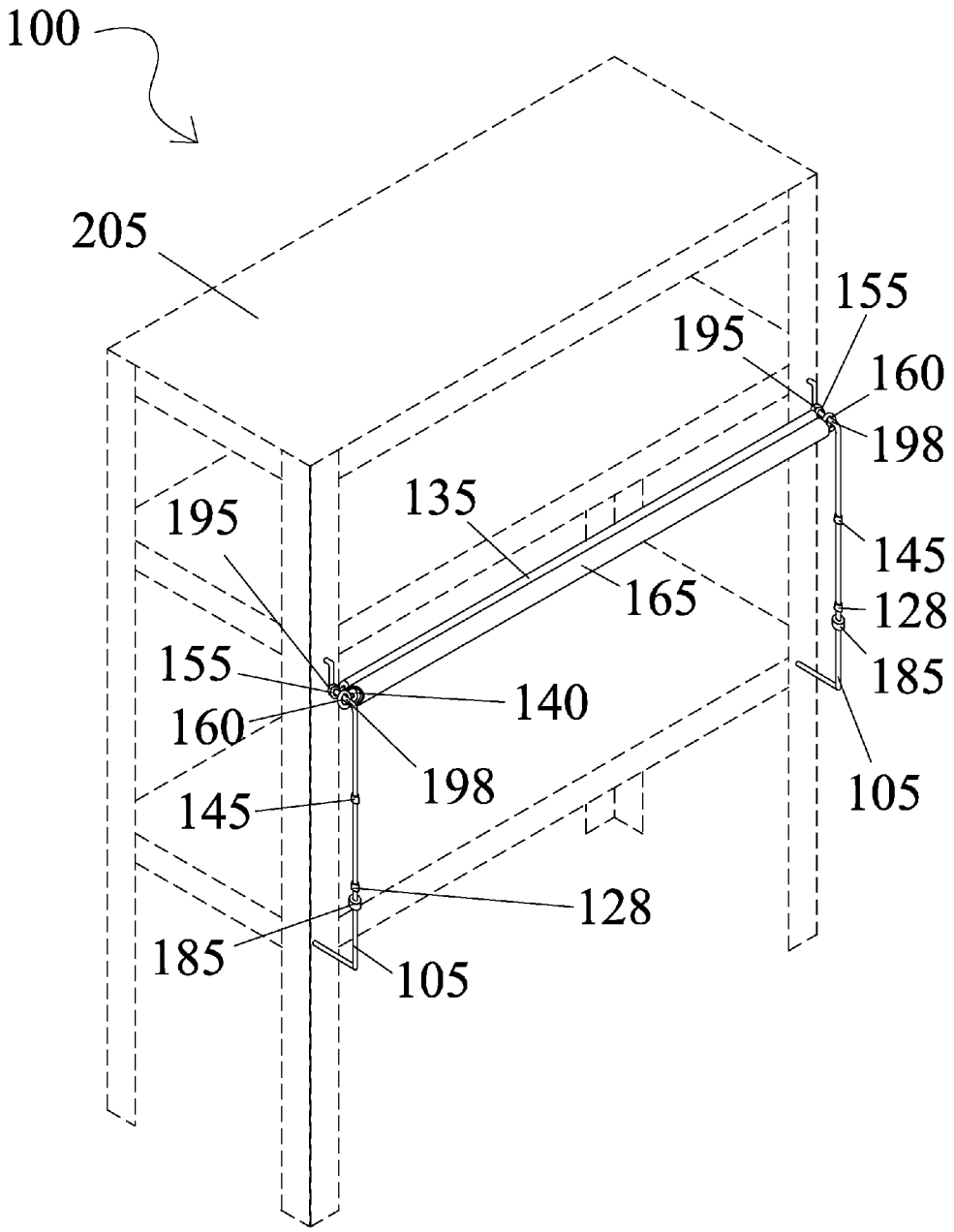
FIG. 15 is a perspective view of a shelf unit having an earthquake-activated security system with a mesh net installed according to an embodiment of the invention.
Figure 16:
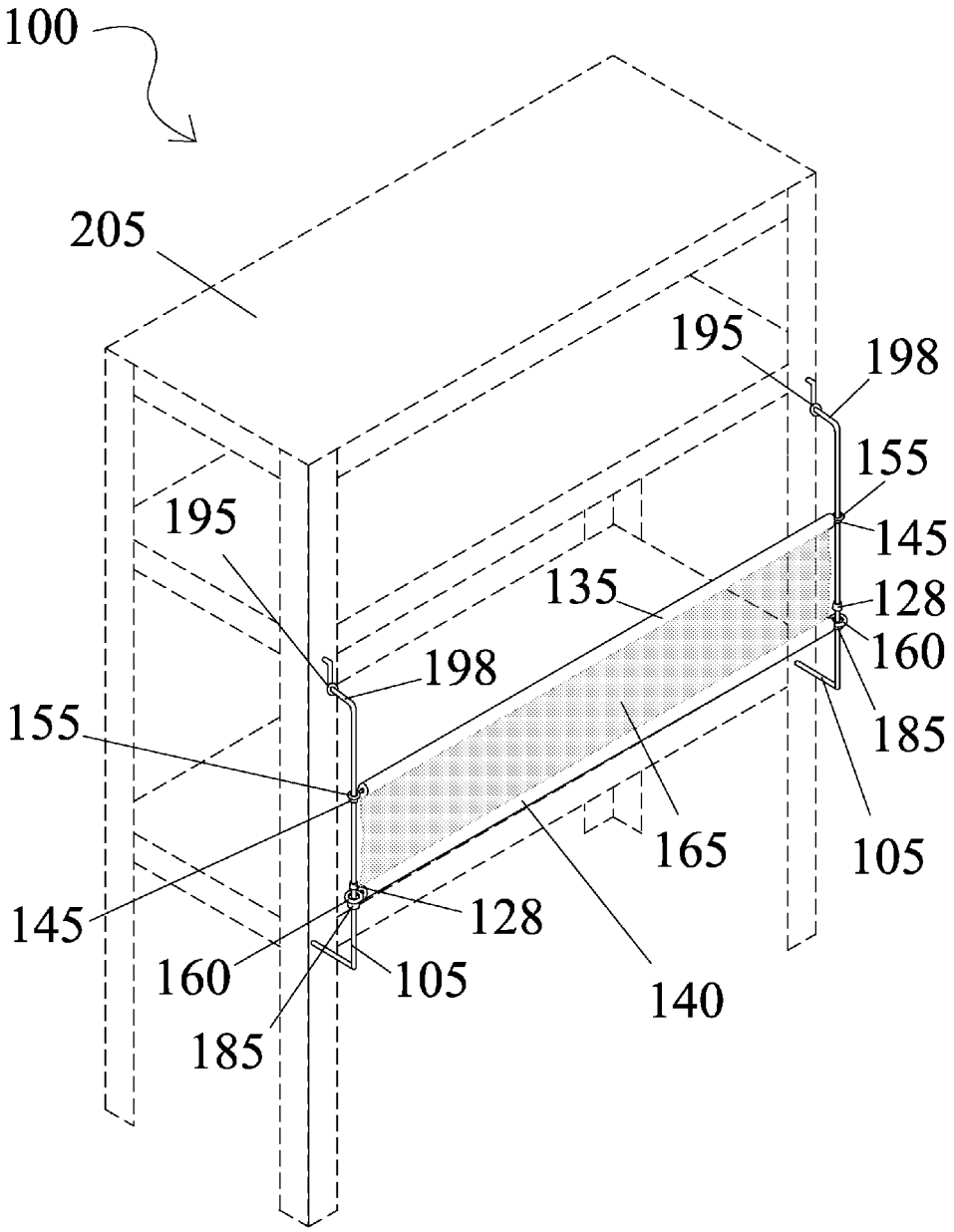
FIG. 16 is a perspective view of the shelf unit having an earthquake-activated security system shown in FIG. 15 in an activated configuration.

Referring to FIGS. 15 and 16, earthquake-activated shelf security system 100 is shown using net mesh 165 which is attached between upper retainer 135 and lower retainer 140. As discussed above, mesh net 165 is used when additional protection is needed.

Figure 17:
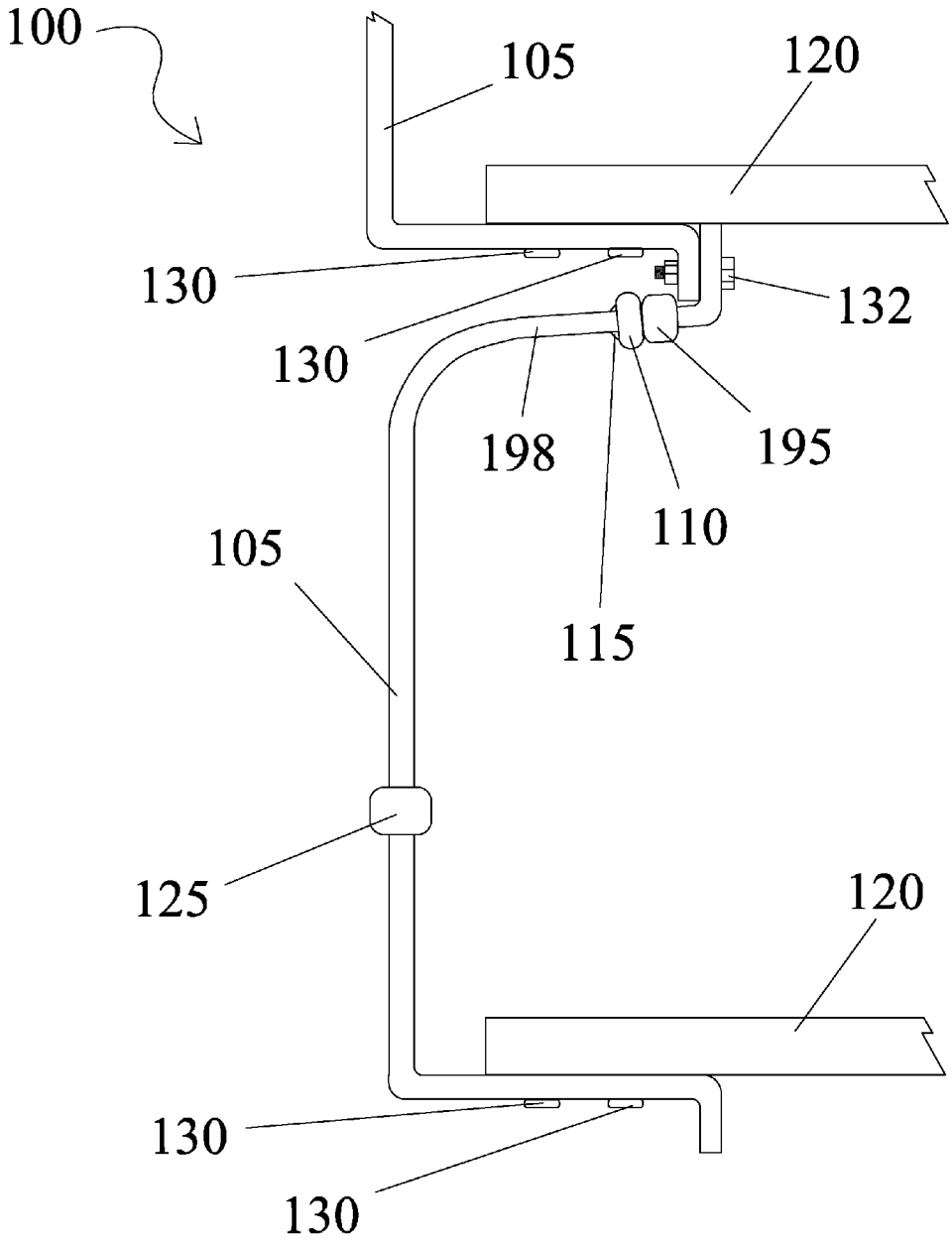
FIG. 17 is a side view of the guide rail shown in FIG. 1 attached to another guide rail using a bolt.
Figure 18:
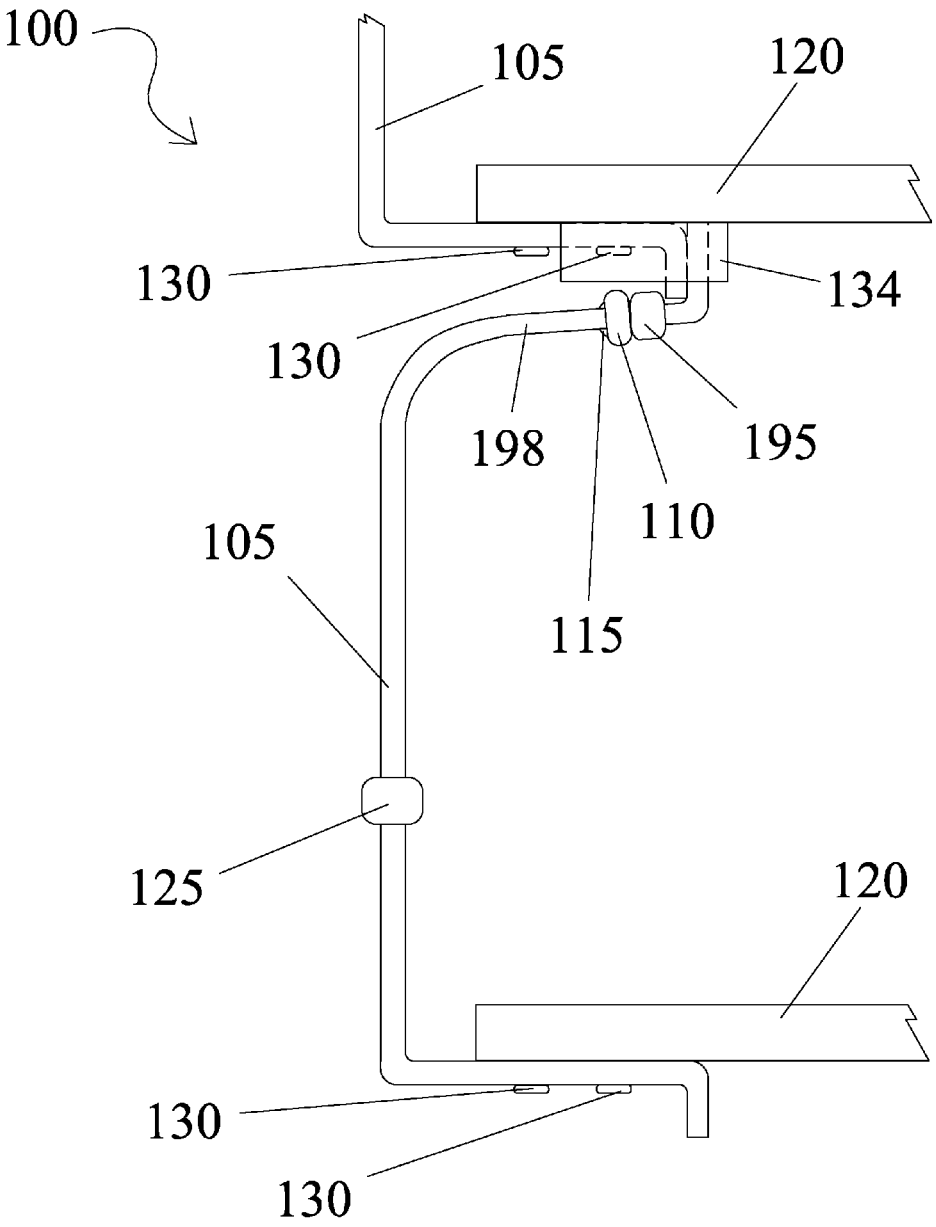
FIG. 18 is a side view of the guide rail shown in FIG. 1 attached to another guide rail using a channel bracket.
Figure 19A:
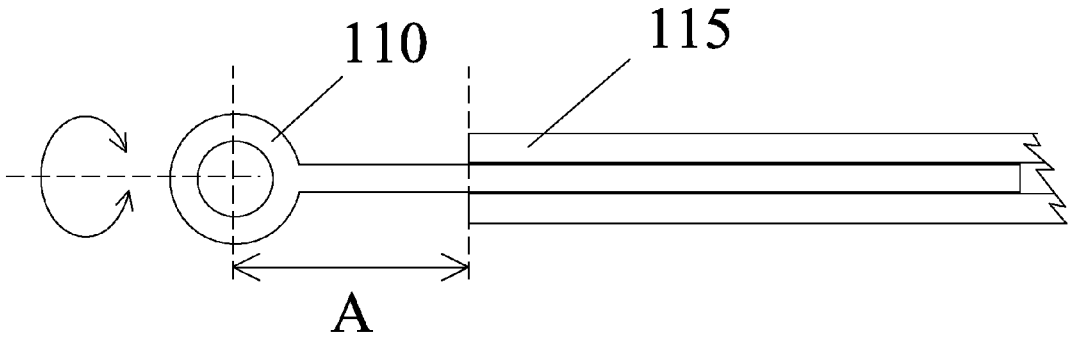
FIG. 19A is a detailed side view of the retainer in a selected position.
Figure 19B:
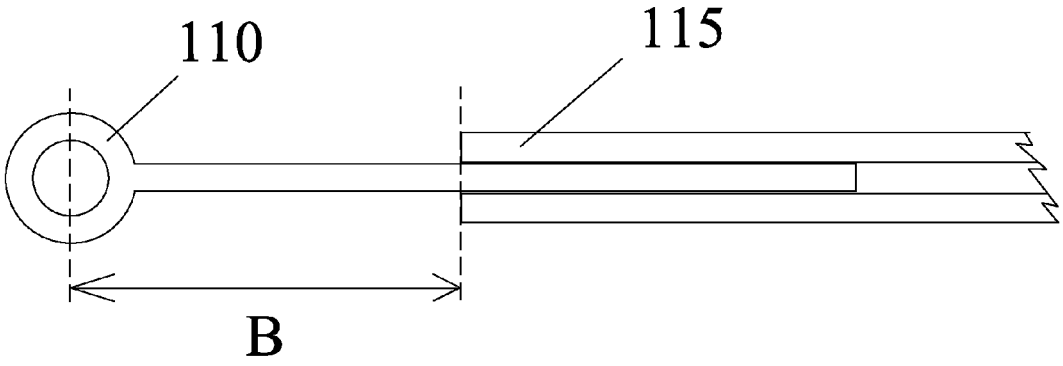
FIG. 19B is a detailed side view of the retainer in a second selected position.

Referring now to FIGS. 17 and 18, guide rails 105 are attached to another guide rail 105 using a bolt 132 (FIG. 17) or a channel bracket 134 (FIG. 18) attached to shelf 120. Of course other fastening methods may be used as long as guide rails 105 are securely held in place.

The distance between guide rails 105 and shelves 120 may be adjusted by providing slots in the portion of guide rails 105 that attach to shelves 120. Other methods of adjusting the distance may be used including mounting adjusting brackets (not shown) or other acceptable adjusting means as is known in the art.

The guide rails used in this invention are generally round metal bars but could be made of other suitable materials including, but not limited to, plastic, composites, wood, etc. Again, although round stock are used, other shapes would be usable such as hexagonal, oval or even square stock as long as the looped ends can travel down the guide rails smoothly and reliably.

Although the instant invention has been described in relation to particular embodiments thereof, many other variations and modifications and other uses will become apparent to those skilled in the art.

What is claimed is:

1. An earthquake-activated shelf security system comprising:

a first guide rail having a first retainer rest portion disposed along a top portion thereon;

a second guide rail having a second retainer rest portion disposed along a top portion thereon;

said first and second retainer rest portion forming a selected angle from a horizontal axis wherein a forward portion of said first and second retainer rest portion is lower than a rearward portion;

a first retainer stop disposed along a lower portion of said first guide rail;

a second retainer stop disposed along a lower portion of said second guide rail;

a retainer having a first and second end;

a looped end disposed on each of said first and second end;

each looped end movably disposed on a respective one of said first and second guide rails wherein said retainer is constrained to move along said first and second guide rails;

an attachment means for attaching said first and second guide rails to a shelf;

said first and second guide rails having a portion that is generally perpendicular to said shelf; and wherein said looped ends are rotatably secured within said retainer.

2. The earthquake-activated shelf security system of claim 1 wherein said attachment means for attaching said first and second guide rails to said shelf comprises using bolts to attach said first and second guide rails therein.

3. The earthquake-activated shelf security system of claim 1 further comprising a third and fourth retainer stop each disposed above a respective one of said first and second retainer stops wherein said third and fourth retainer stops are smaller in diameter than said first and second retainer stops wherein said looped ends are adapted to fit over said third and fourth retainer stops.

4. The earthquake-activated shelf security system of claim 1 wherein said selected angle is between two and five degrees.

5. The earthquake-activated shelf security system of claim 1 further comprising:

a first backstop disposed along a rearward portion of said first retainer rest portion;

a second backstop disposed along a rearward portion of said second retainer rest portion;

said first and second backstop being adapted to position said retainer when said retainer is placed on said first and second retainer rest portion.

6. The earthquake-activated shelf security system of claim 5 wherein said first and second retainer stops and said first and second backstops being adapted to frictionally slide along said guide rails.

7. The earthquake-activated shelf security system of claim 1 wherein said retainer is adapted to moveably retain each of said looped ends within a respective opening defined along a longitudinal axis passing through the center of said retainer wherein said looped ends are free to rotate as well as move along said longitudinal axis.

* * * * *